US010691044B2

(12) United States Patent
Fujii et al.

(10) Patent No.: US 10,691,044 B2
(45) Date of Patent: Jun. 23, 2020

(54) BELT CONVEYOR DEVICE AND IMAGE FORMING APPARATUS PROVIDED WITH THE SAME

(71) Applicant: CANON KABUSHIKI KAISHA, Tokyo (JP)

(72) Inventors: Daisuke Fujii, Kamagaya (JP); Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/508,179

(22) Filed: Jul. 10, 2019

(65) Prior Publication Data

US 2020/0026222 A1 Jan. 23, 2020

(30) Foreign Application Priority Data

Jul. 17, 2018 (JP) ..... 2018-134289

(51) Int. Cl.
*G03G 15/20* (2006.01)
*G03G 15/16* (2006.01)

(52) U.S. Cl.
CPC ... *G03G 15/161* (2013.01); *G03G 2221/1642* (2013.01)

(58) Field of Classification Search
CPC ..... G03G 15/161; G03G 15/1615; G03G 2221/1678; G03G 2221/1642
See application file for complete search history.

(56) References Cited

U.S. PATENT DOCUMENTS 7,693,452 B2 * 4/2010 Kaiho ..... G03G 21/1623 399/121
7,920,808 B2 * 4/2011 Ohkushi ..... G03G 15/161 399/121

FOREIGN PATENT DOCUMENTS

JP 2004318003 A 11/2004
JP 2007271682 A 10/2007
JP 4310097 B2 8/2009

* cited by examiner

*Primary Examiner* — Hoang X Ngo
(74) *Attorney, Agent, or Firm* — Canon U.S.A., Inc. IP Division

(57) ABSTRACT

There are included a first grip portion provided on a first end side of a belt conveyor device, in a width direction intersecting a rotational direction of the belt, and a second grip portion and an electrical contact portion provided on a second end side of the belt conveyor device. A center of gravity position of the belt conveyor device is provided on a downstream side of a center of the belt conveyor device and a range where the center of gravity position of the belt conveyor device is provided in a range where the contact portion and the first grip portion are provided. The second grip portion is provided on an upstream side of the center of gravity position of the belt conveyor device in an insertion direction of the belt conveyor device.

8 Claims, 9 Drawing Sheets

BELT CONVEYOR DEVICE AND IMAGE FORMING APPARATUS PROVIDED WITH THE SAME

BACKGROUND OF THE DISCLOSURE

Field of the Disclosure

The present disclosure relates to a belt conveyor device, or an image forming apparatus that uses an electrophotographic method or an electrostatic recording method, such as a copier, a printer or a facsimile device.

Description of the Related Art

With an image forming apparatus such as a printer or a copier, components and units such as an image formation unit, a belt conveyor device, various rollers and the like are regularly replaced to keep providing stable images to consumers. With respect to the belt conveyor device among such components and units, an endurance life of a belt member is comparatively shorter than that of a unit main body, and the belt member is replaced from the standpoint of running cost. At the time of replacing the belt member, the belt conveyor device is removed from a main body of the image forming apparatus.

Accordingly, a grip member is provided on the belt conveyor device from the standpoint of operability. A user or a maintenance worker may thus carry the belt conveyor device by supporting the grip member, and a structure with high operability is achieved. Conventionally, for example, Japanese Patent No. 4310097 proposes a structure according to which a grip portion is provided on both sides of the belt conveyor device. The belt conveyor device may thereby be held after being removed from the main body.

However, in Japanese Patent No. 4310097, the grip portions are not provided at positions corresponding to a center of gravity position of the belt conveyor device. Accordingly, the belt conveyor device tends to be unstably gripped. Therefore, there is a risk that the belt conveyor device bumps into another part to cause damage, at the time of being mounted in the apparatus main body.

Accordingly, a grip portion is desirably provided at a position corresponding to the center of gravity position of the belt conveyor device.

On the other hand, depending on a unit to be mounted on the belt conveyor device, the center of gravity position of the belt conveyor device is possibly on a downstream side in an insertion direction of the belt conveyor device. In such a case, there are following problems. That is, from the standpoint of stability of gripping, the position where the grip portion is provided should be on a downstream side in the insertion direction of the belt conveyor device so as to correspond to the center of gravity position. However, normally, an electrical contact portion for applying a transfer bias is provided on the belt conveyor device. If the electrical contact portion is to be arranged in a manner avoiding the grip portion, the electrical contact portion is arranged on an upstream side in the insertion direction of the belt conveyor device. However, if the electrical contact portion is arranged on the upstream side in the insertion direction of the belt conveyor device, a sliding distance from an electrical contact portion on the main body side to the belt conveyor device is increased at the time of inserting the belt conveyor device into the apparatus main body. Accordingly, the belt conveyor device becomes difficult to insert into the apparatus main body.

SUMMARY OF THE DISCLOSURE

The present disclosure provides a belt conveyor device or an image forming apparatus with which a sliding distance between an electrical contact on an apparatus main body side and the belt conveyor device may be suppressed while suppressing reduction in stability of gripping of the belt conveyor device, even for a belt conveyor device, a center of gravity position of which is positioned on a downstream side in an insertion direction of the belt conveyor device.

A belt conveyor device can be detachably attachable to a main body of an image forming apparatus, and the belt conveyor device includes: a belt of an endless shape; a plurality of rollers where the belt is stretched; a main body frame for rotatably supporting the plurality of rollers; a first grip portion provided on a first end side of the main body frame in a width direction intersecting a rotational direction of the belt conveyor device with respect to the main body; a second grip portion provided on a second end side of the main body frame in the width direction; and an electrical contact portion, provided on the second end side of the main body frame in the width direction, to be electrically connected to the main body, wherein a center of gravity position of the belt conveyor device is provided on a downstream side of a center of the belt conveyor device and a range where the center of gravity position of the belt conveyor device is provided in a range where the contact portion and the first grip portion are provided, and the second grip portion is provided on an upstream side of the center of gravity position of the belt conveyor device in an insertion direction of the belt conveyor device.

Further features and aspect of the present disclosure will become apparent from the following description of example embodiments (with reference to the attached drawings).

BRIEF DESCRIPTION OF THE DRAWINGS

FIG. 2A is a state where a belt conveyor device is mounted, and FIG. 2B is a state where the belt conveyor device is being inserted.

FIG. 3A is a state where an intermediate transfer belt is stretched across, and FIG. 3B is a state where the intermediate transfer belt is removed.

FIG. 4A shows a case for color image formation, FIG. 4B shows a case for monochrome image formation, and FIG. 4C shows a case for separation.

DESCRIPTION OF THE EMBODIMENTS

First Example Embodiment

<Example Image Forming Apparatus>

Figure 1:
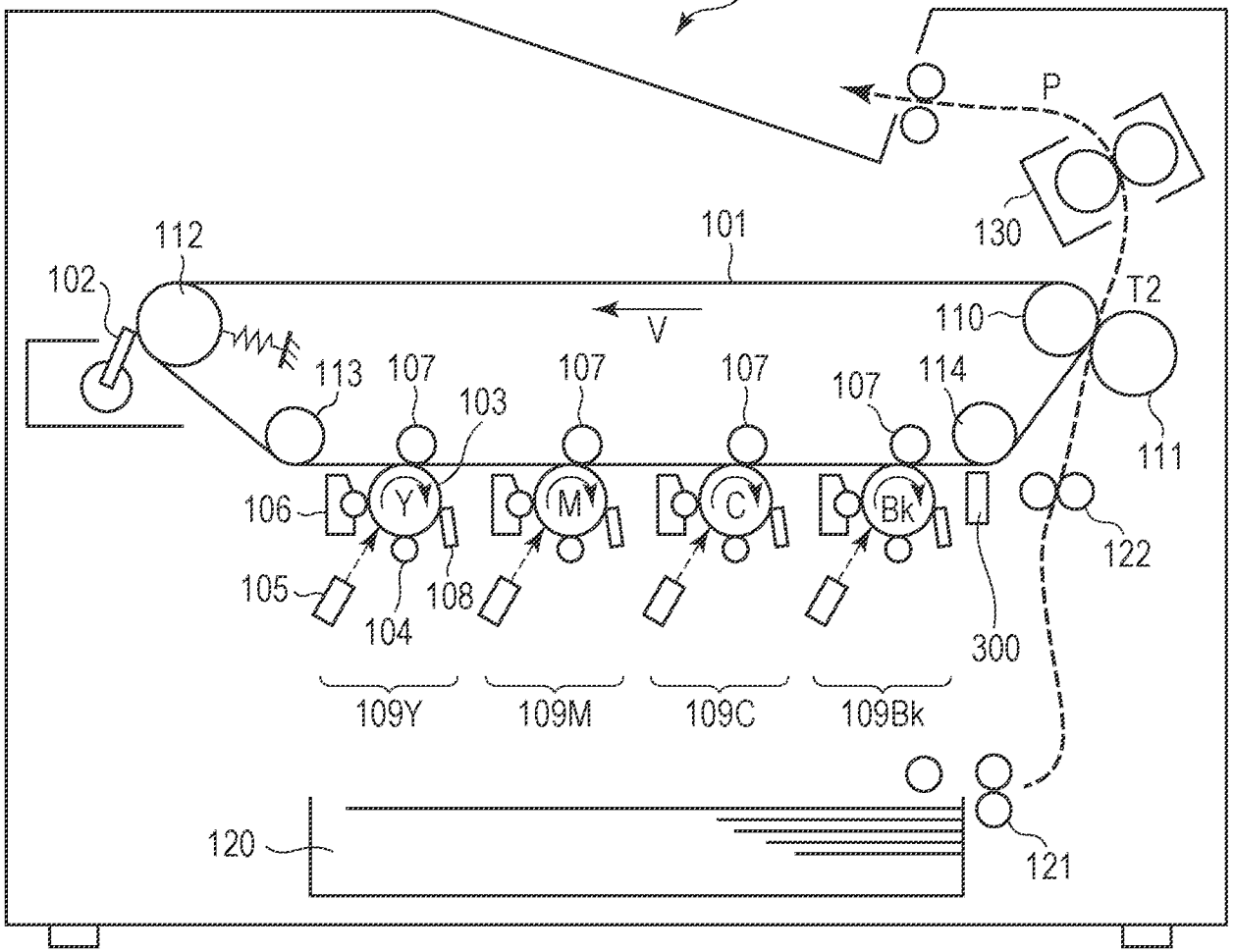
FIG. 1 is a schematic cross-sectional view of an example image forming apparatus according to a present embodiment.

FIG. 1 is a schematic cross-sectional view for describing an example image forming apparatus according to a present embodiment. An image forming apparatus 100 of the present embodiment is a tandem-type color digital printer of an intermediate transfer method including four image forming units (109Y, 109M, 109C, 109Bk) along an intermediate transfer belt 101. In the present embodiment, structure and operation are substantially the same for the image forming units 109Y, 109M, 109C, 109Bk except that toners of different colors are used. Accordingly, in the following, in the case where the elements do not have to be distinguished from one another, the elements will be described in a general manner by omitting Y, M, C, and Bk at the end of reference signs indicating being elements of respective colors.

Surfaces of photosensitive drums 103 as four image carriers are each charged with a uniform charge by a respective charging roller 104. An image signal of yellow, magenta, cyan, or black is input to each laser scanner 105, and the drum surface is irradiated by a laser beam according to the image signal, and the charge is neutralized and a latent image is formed. The latent images formed on the drums are each developed with a yellow, magenta, cyan, or black toner by a developing device 106. Toner images developed on respective drums are sequentially primarily transferred to the intermediate transfer belt 101 by a bias applied to primary transfer rollers 107. The bias that is applied to the primary transfer roller 107 is applied from a contact portion (HVa, HVb, HVc, HVd) that is electrically connected to a main body of the image forming apparatus.

Figure 2A:
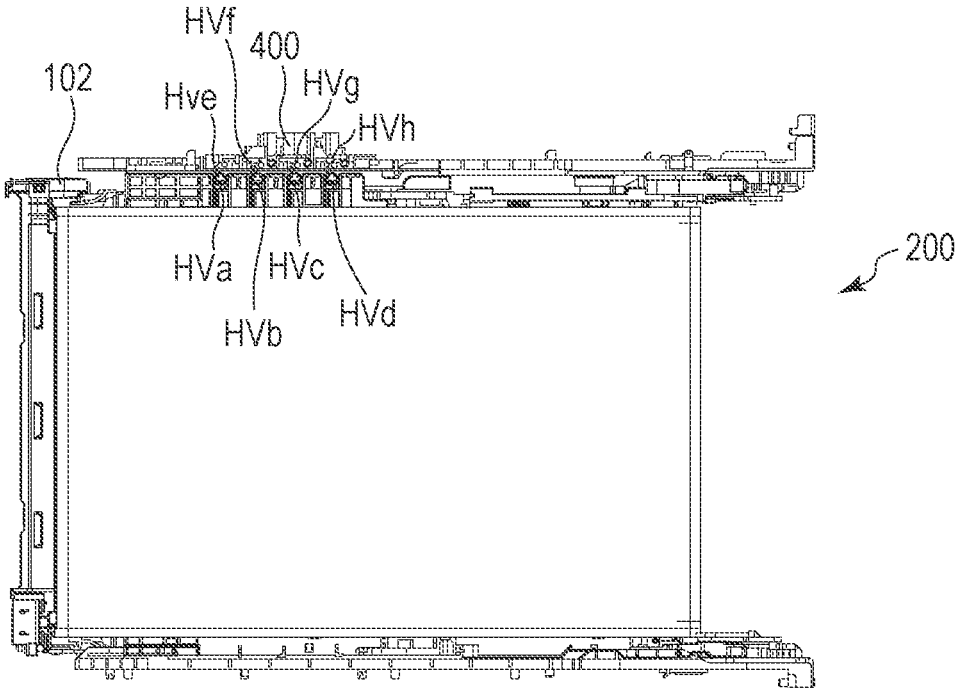
FIGS. 2A and 2B are schematic cross-sectional views for describing electrical contact portions of the image forming apparatus according to the present embodiment.
Figure 2B:
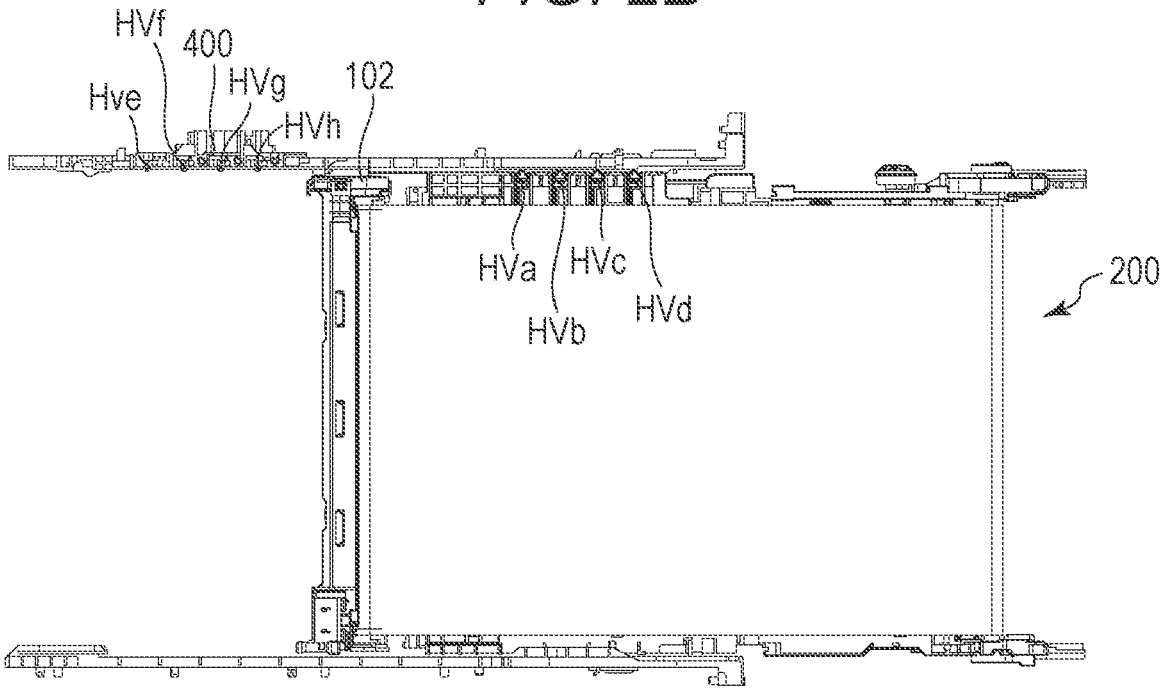

Here, as shown in FIG. 2A, an apparatus main body power feeding unit 400 has a structure according to which each contact member (HVe, HVf, HVg, HVh) of the apparatus main body power feeding unit 400 is provided at a position that abuts a respective contact portion (HVa, HVb, HVc, HVd). Accordingly, electrical paths are formed from the apparatus main body power feeding unit 400 to a belt conveyor device 200. The contact members (HVe, HVf, HVg, HVh) of the apparatus main body power feeding unit 400 presses against the respective contact portions (HVa, HVb, HVc, HVd) with a pressure force of about 150 gf so as to be reliably electrically connected. Furthermore, as shown in FIG. 2B, at the time of insertion of the belt conveyor device 200 into the apparatus main body, a side surface of the belt conveyor device 200 rubs against the contact members (HVe, HVf, HVg, HVh) of the apparatus main body power feeding unit 400. Moreover, the contact members (HVe to HVh) of the apparatus main body power feeding unit 400 are supported in a manner retractable from the side surface of the belt conveyor device 200. Accordingly, the contact members (HVe, HVf, HVg, HVh) are retracted according to a shape of the side surface of the belt conveyor device 200 at a time of an insertion operation of the belt conveyor device 200.

Then, a full-color toner image obtained by superimposing toner images of respective colors is formed on a surface of the intermediate transfer belt 101. Transfer residual toner on the photosensitive drum 103 is collected by a drum cleaner 108. A sensor unit 300 detects a toner density or a positional (color) shift on the intermediate transfer belt 101, and also, a toner image formation timing. Control for optimizing the density of toner images to be formed by the four image forming units 109, a formation timing and the like is performed on the basis of values detected by the sensor unit 300.

For its part, a transfer receiving material P, such as a sheet of paper, fed from a cassette feeding unit 120 by feed rollers 121 is sent to registration rollers 122, and is further sent to a secondary transfer unit T2 in synchronization with the toner image on the intermediate transfer belt. The toner image on the intermediate transfer belt is transferred to the transfer receiving material P by a secondary transfer inner roller 110 and a secondary transfer outer roller 111, and is fixed on the transfer receiving material P by heat and pressure at a fixing unit 130, and the transfer receiving material P is then ejected outside the machine. Moreover, transfer residual toner on the intermediate transfer belt 101, which is not transferred at the secondary transfer unit T2, is collected by a cleaning device 102.

<Example Belt Conveyor Device>

Figure 3A:
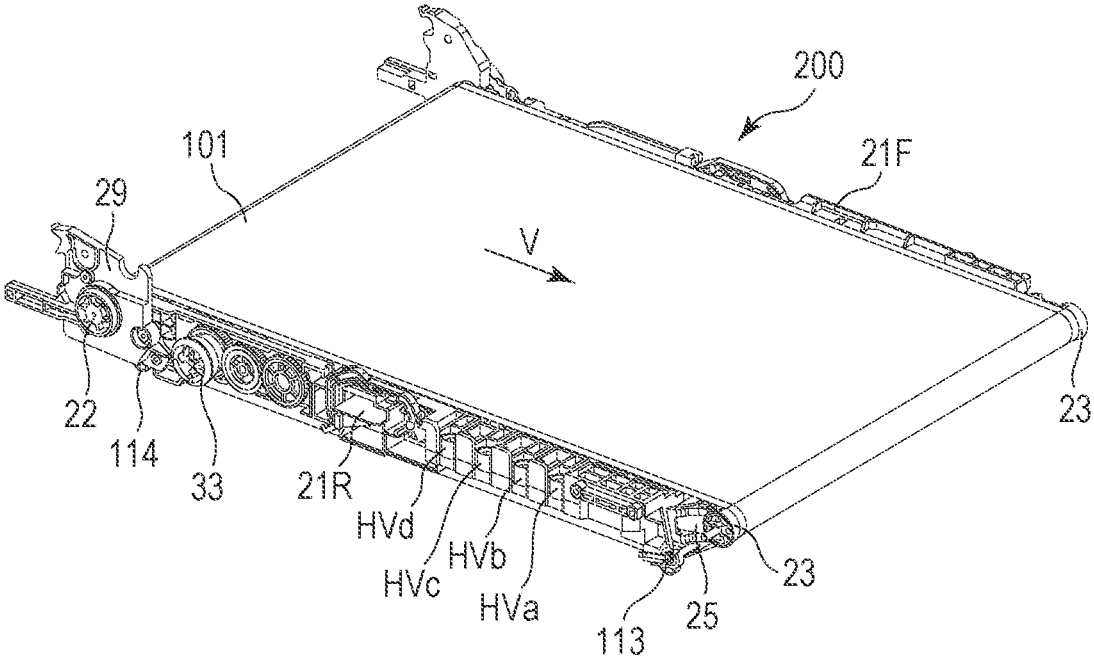
FIGS. 3A and 3B are perspective views of the belt conveyor device according to the present embodiment.
Figure 3B:
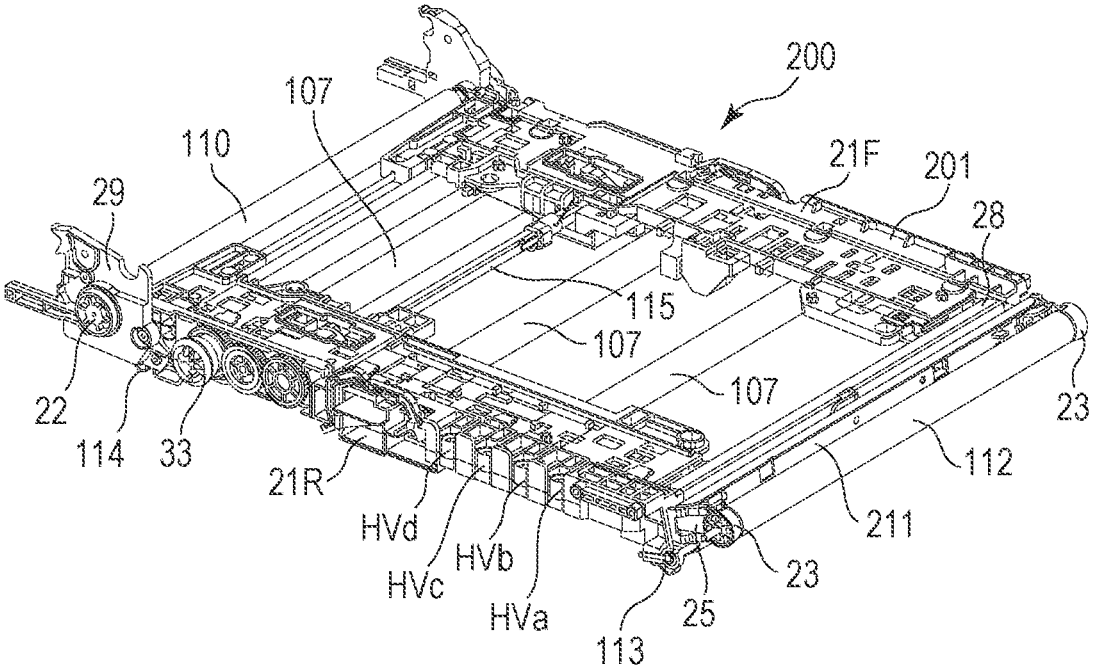

Next, a description will be given of the belt conveyor device of the present embodiment. The belt conveyor device 200 of the present embodiment is a component for conveying the intermediate transfer belt 101, which is an endless belt. FIGS. 3A and 3B are perspective views of the belt conveyor device 200 where the intermediate transfer belt 101 is installed. FIG. 3A shows a state where the intermediate transfer belt 101 is stretched across, and FIG. 3B shows a state where the intermediate transfer belt 101 is removed. The intermediate transfer belt 101 is stretched across by a plurality of tension rollers. In the present embodiment, the intermediate transfer belt 101 is stretched across by four rollers, namely, the secondary transfer inner roller 110, a pre-secondary-transfer roller 114, an idler roller 113, and a steering roller 112.

As shown in FIGS. 3A and 3B, the secondary transfer inner roller 110, the pre-secondary-transfer roller 114, and the idler roller 113 are each rotatably supported at both ends in an axial direction while being sandwiched between a front frame 21F and a rear frame 21R.

The steering roller 112 is swingably supported, through an oscillating plate 211, by a frame 201, which is a main body frame of the belt conveyor device 200 including the front frame 21F and the rear frame 21R. A drive coupling 22 is attached to one end portion of the secondary transfer inner roller 110 in the axial direction. A driving force is transmitted to the drive coupling 22 by the drive coupling 22 being coupled to an output shaft of a belt drive unit, not shown. A surface of the secondary transfer inner roller 110 is formed of a material with a relatively high friction coefficient, such as rubber, and a roller surface drives and conveys the intermediate transfer belt 101 in an arrow V direction in FIG. 3A when the driving force is transmitted. Additionally, in the present embodiment, the drive coupling 22 is used as a driving force transmission unit, but coupling may alternatively be performed using a gear. As described later, the belt conveyor device 200 is provided with the cleaning device 102, which is a detachable unit for cleaning the surface of the intermediate transfer belt 101 and which is detachably provided on the frame 201. Moreover, the electrical contact portions (HVa, HVb, HVc, HVd) forming electrical paths for applying a bias from the main body side to the primary transfer rollers are provided on the frame 201 of the belt conveyor device 200.

Moreover, in the present embodiment, a following structure is adopted to reduce, as much as possible, the sliding distance by which the belt conveyor device 200 and the electrical contact portion on the main body side slide at the time of insertion of the belt conveyor device 200 into the apparatus main body. That is, as shown in FIGS. 3A and 3B, the electrical contact portions (HVa, HVb, HVc, HVd) are arranged to be on the downstream side as much as possible in the insertion direction of the belt conveyor device 200. This allows a sliding load at a time of removing the belt conveyor device 200 from the apparatus main body to be reduced.

<Example Primary Transfer Roller Separating Mechanism>

Figure 4A:
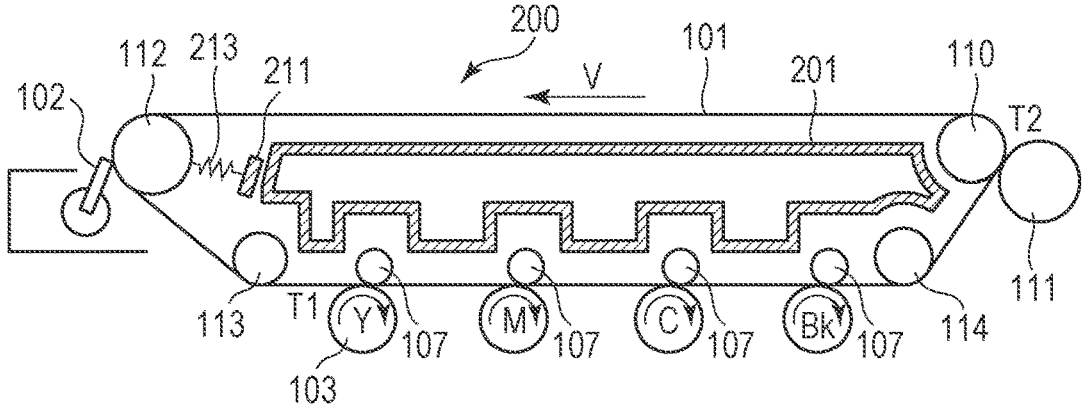
FIGS. 4A to 4C describe an example arrangement of primary transfer rollers according to the present embodiment.
Figure 4B:
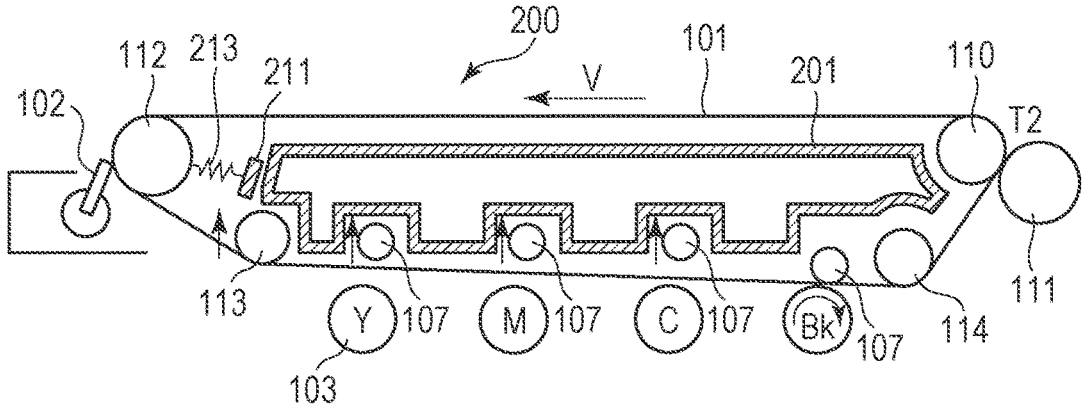
Figure 4C:
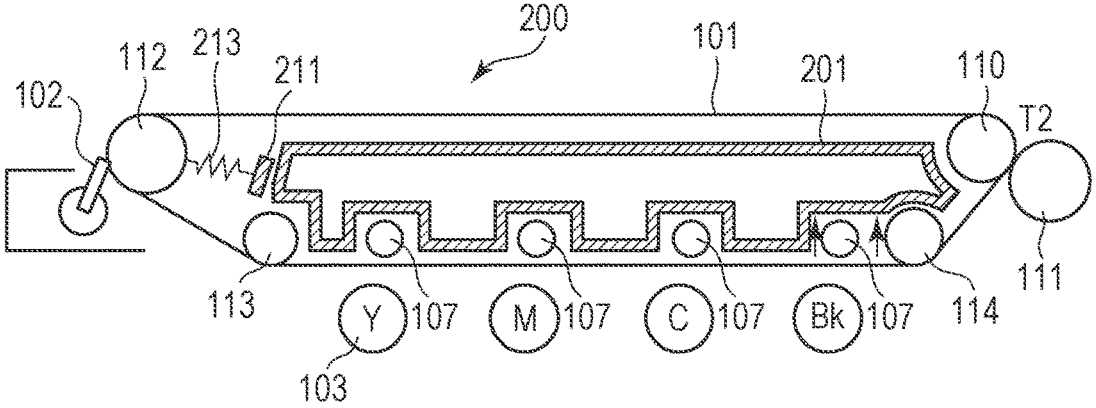

FIGS. 4A to 4C are schematic cross-sectional views for describing a primary transfer roller separating mechanism according to the present embodiment.

FIG. 4A is a diagram describing positions of the primary transfer rollers 107 at the time of full-color image formation. As shown in FIG. 4A, the primary transfer rollers 107 form a color image by each primary transfer roller 107 forming a primary transfer unit T1 with the respective photosensitive drum 103 through the intermediate transfer belt 101, and transferring toner images in yellow, magenta, cyan, and black in a superimposed manner. On the other hand, at a time of monochrome image formation, the primary transfer rollers 107 for yellow, magenta, and cyan are lifted by a lifting and lowering mechanism, not shown, as shown in FIG. 4B. The intermediate transfer belt 101 and the photosensitive drums 103 are thereby separated. Accordingly, at the time of monochrome image formation, the photosensitive drums for yellow, magenta, and cyan may be stopped. Furthermore, in a standby state of the image forming apparatus, the primary transfer roller for black and the pre-secondary-transfer roller 114 are also moved, as shown in FIG. 4C. The intermediate transfer belt 101 may thus be completely separated from the four photosensitive drums 103.

As described above, there are three modes of arrangement of the primary transfer rollers 107, namely, for the case of color image formation as shown in FIG. 4A, for the case of monochrome image formation as shown in FIG. 4B, and for the case of separation as shown in FIG. 4C. A separation position in FIG. 4C is provided such that, at the time of carrying the image forming apparatus, the photosensitive drums 103 are not contacted and damaged. Furthermore, the positions in FIG. 4B are for increasing the life of the photosensitive drums 103 by not rotating unnecessarily the photosensitive drums 103 which are not used at the time of monochrome image formation.

<Example Cleaning Device>

Figure 5:
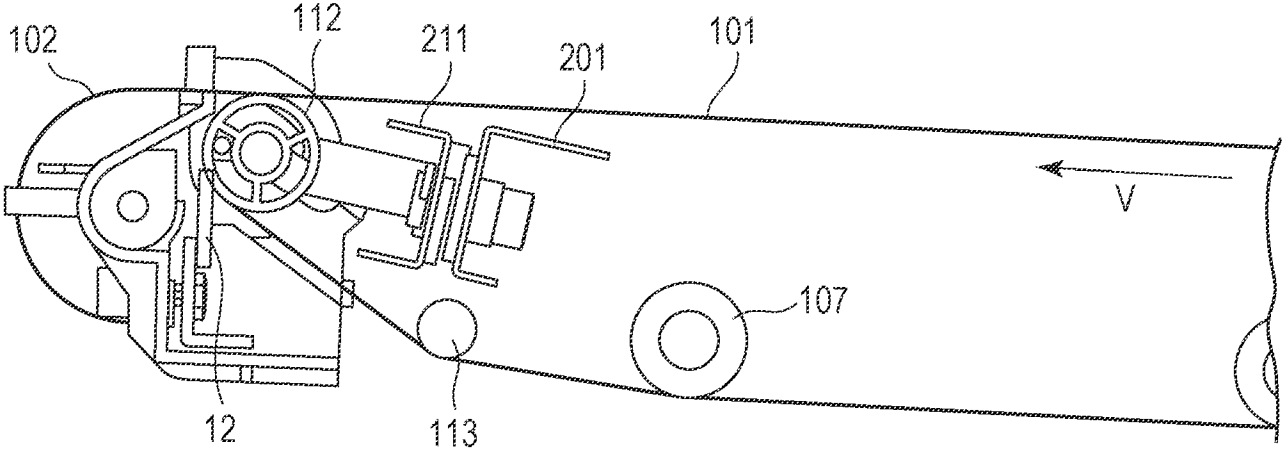
FIG. 5 is a schematic cross-sectional view of the belt conveyor device according to the present embodiment.

FIG. 5 is an explanatory diagram of a structure of the cleaning device 102 (cleaning unit 102) for cleaning the intermediate transfer belt 101.

As shown in FIG. 5, the cleaning device 102 includes a cleaning blade 12 that collects transfer residual toner by rubbing against an outer circumferential surface of the intermediate transfer belt 101. The cleaning blade 12 is provided facing the steering roller 112 across the intermediate transfer belt 101. The cleaning blade 12 is arranged in a counter direction with respect to a movement direction V of the intermediate transfer belt 101. That is, a tip end side of the cleaning blade 12 is positioned on the upstream side than a root side in the movement direction of the intermediate transfer belt 101. The cleaning device 102 collets transfer residual toner and the like which are remaining on the intermediate transfer belt 101 without being transferred to the transfer receiving material P. The cleaning blade 12 is formed of urethane rubber. Hardness of the urethane rubber is JIS-A hardness of 75, and a thickness of the urethane rubber is 2 FF. An abutting angle of the cleaning blade 12 is 25 degrees, and an abutting pressure is 3 N/F (30 gf/cF). However, the present disclosure is not limited to be such.

<Example Belt Replacement>

Next, a procedure of replacing the intermediate transfer belt 101 according to the present embodiment will be described with reference to FIG. 6 and FIGS. 7A to 7E.

The intermediate transfer belt 101 is consumable. In a case where the life is expired by use over a long period of time or in a case where the belt becomes unusable due to unintended scratches, dents or the like, the belt conveyor device 200 may be used continuously by replacing the belt.

First, the belt conveyor device 200 is removed from the image forming apparatus 100. At this time, the positions of the primary transfer rollers 107 of the belt conveyor device 200 are at any of those at the time of separation, at the time of monochrome image formation, and at the time of color image formation described above.

Figure 6:
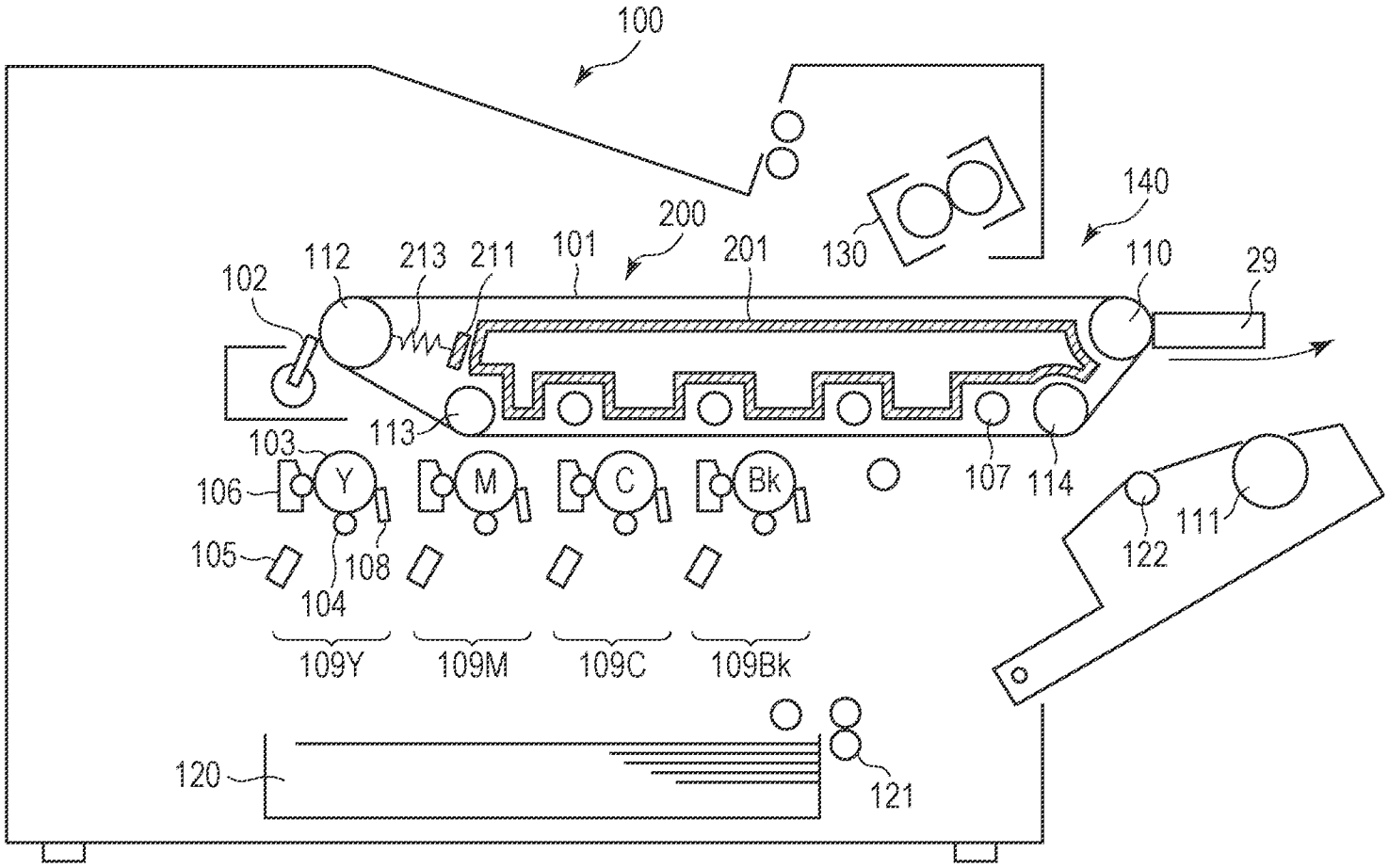
FIG. 6 is a schematic cross-sectional view of the image forming apparatus according to the present embodiment.

As shown in FIG. 6, an opening 140 is formed on the image forming apparatus 100, on one side surface where the four image forming units (109Y, 109M, 109C, 109Bk) are arranged next to one another. The belt conveyor device 200 may be removed, together with the cleaning device 102, from inside a housing of the image forming apparatus 100 through the opening 140. That is, the belt conveyor device 200 is configured to be removable from the image forming apparatus main body through the opening 140. The belt conveyor device 200 is provided with a front-side grip portion 20*a* and a rear-side grip portion 20*b* as grip portions which are used to grip the belt conveyor device 200 after it is removed from the image forming apparatus main body. The front-side grip portion 20*a* and the rear-side grip portion 20*b* are provided on one end side and the other end side, respectively, in a width direction intersecting the insertion direction of the belt conveyor device 200. That is, the front-side grip portion 20*a* is provided on a front side of the frame 201 of the belt conveyor device 200, and the rear-side grip portion 20*b* is provided on a rear side of the frame 201.

At the time of maintenance of the belt conveyor device 200, a user or a maintenance worker opens a cover of the image forming apparatus 100. Then, a handle portion 29 of the belt conveyor device 200 provided on a front side of the belt conveyor device 200 is held, and the front-side grip portion 20*a* and the rear-side grip portion 20*b* are pulled outside. The user grips the front-side grip portion 20*a* and the rear-side grip portion 20*b* of the belt conveyor device 200 shown in FIG. 7A, and pulls out the entire body, maintains the grip on the belt conveyor device 200, and horizontally places the belt conveyor device 200 on a workbench or the like.

Figure 7A:
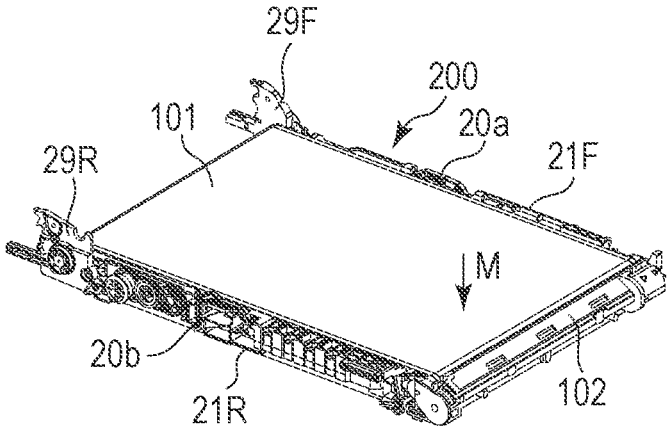
FIGS. 7A to 7E are each an explanatory view for describing a task performed at a time of replacing the intermediate transfer belt according to the present embodiment.
Figure 7D:
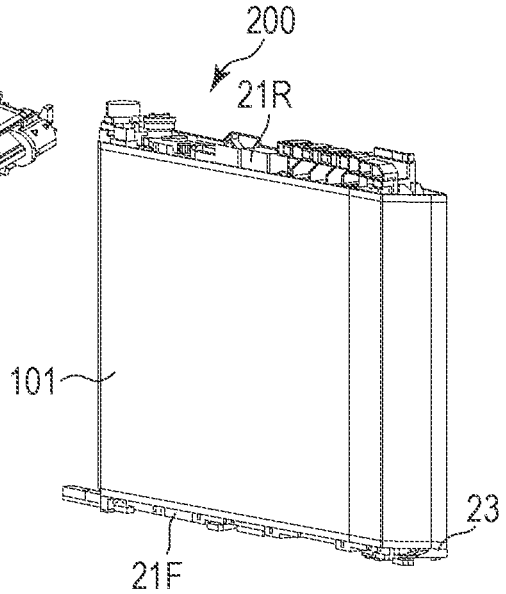
Figure 7B:
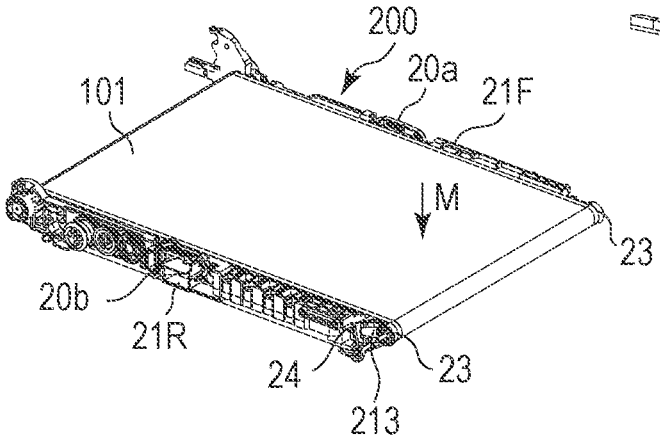
Figure 7E:
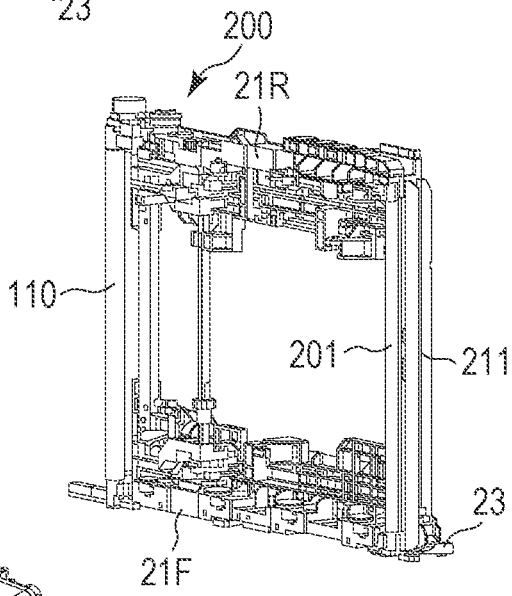
Figure 7C:
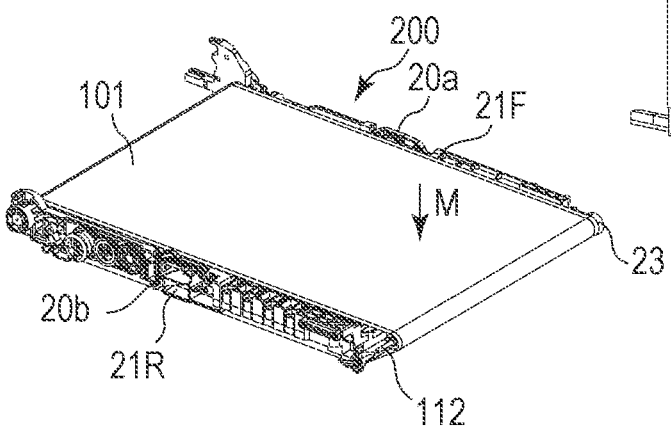

The cleaning device 102 and a handle member 29R are removed in a state where the belt conveyor device 200 is horizontally placed (FIG. 7A→FIG. 7B). Tension springs 213 on both sides, and a steering bearing 23 and a slide guide 24 on the handle member 29R side are removed (FIG. 7B→FIG. 7C). The belt conveyor device 200 is placed upright with a handle member 29F on a bottom side, and the steering roller 112 is pulled out in an upward direction, and the intermediate transfer belt 101 is loosened (FIG. 7C→FIG. 7D).

At this time, the user or the maintenance worker grips and raises the front-side grip portion 20*a* and the rear-side grip portion 20*b* of the belt conveyor device 200 alone. Then, the intermediate transfer belt 101 is pulled out in an upward direction, and a task of removing the intermediate transfer belt 101 is completed (FIG. 7D→FIG. 7E).

Then, in a mounting procedure for a new intermediate transfer belt 101, the intermediate transfer belt 101 is attached by performing a task in a reverse order of removal. First, the intermediate transfer belt 101 is inserted into the belt conveyor device 200 from above, and is attached (FIG. 7E→FIG. 7D). Next, the steering roller 112 is inserted and attached inside the intermediate transfer belt 101 (FIG. 7D→FIG. 7C). Then, the belt conveyor device 200 is gripped, and is horizontally placed on a workbench or the like. Then, the steering bearing 23 and the slide guide 24 are attached. Furthermore, the tension springs 213 are attached on both sides to cause the intermediate transfer belt 101 to be stretched across (FIG. 7C→FIG. 7B). Lastly, the cleaning device 102 and the handle member 29R are attached (FIG. 7B→FIG. 7A).

<Structure of Grip Portion of Belt Conveyor Device (Comparative Example)>

Next, before describing a structure of a grip portion of the belt conveyor device as a characteristic part of the present embodiment, a structure of a grip portion of a comparative example will be described with reference to FIG. 8.

Figure 8:
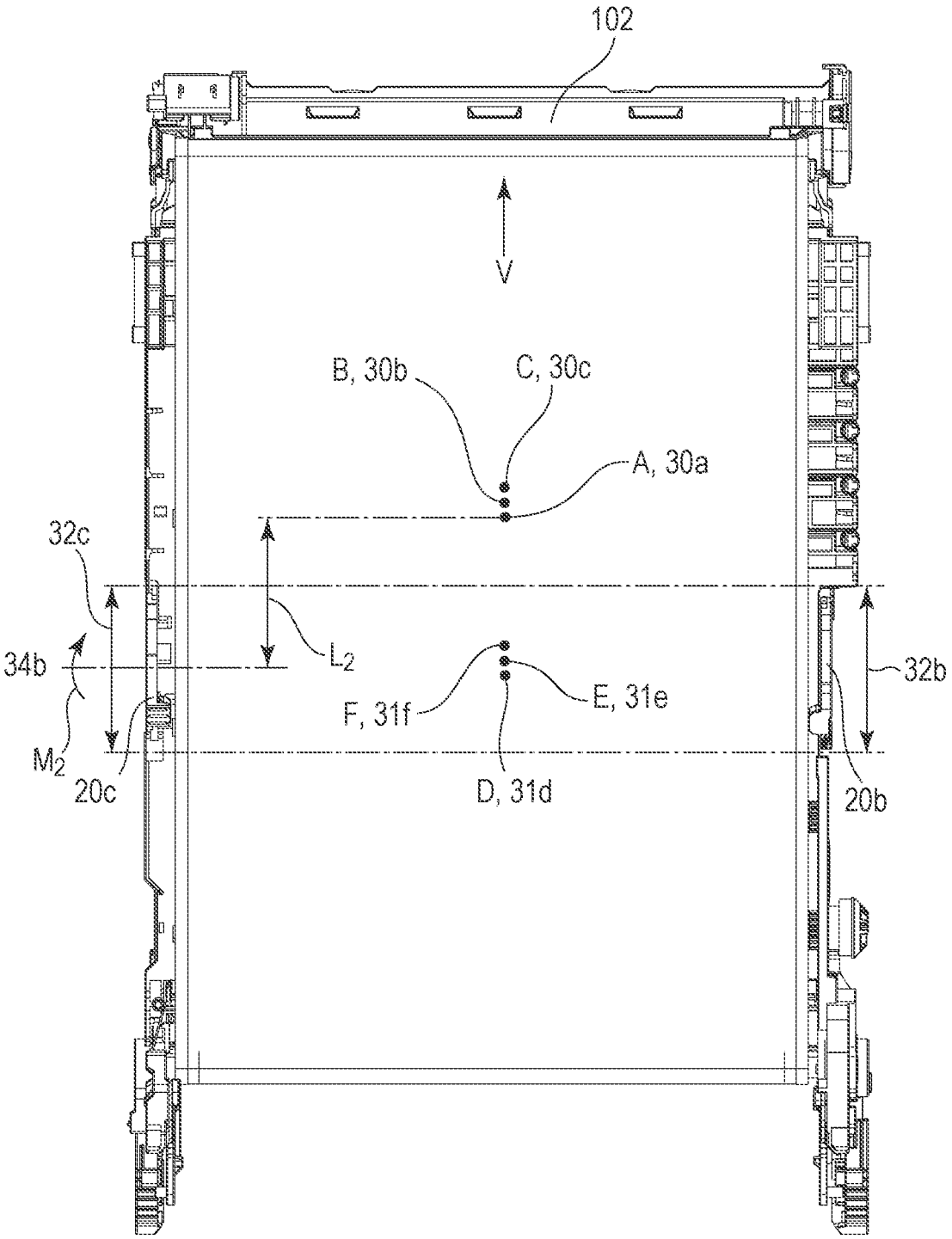
FIG. 8 is a top view of a belt conveyor device according to a comparative example.

A belt conveyor device 200 of a comparative example is shown in FIG. 8. A center of gravity position of the belt conveyor device 200 changes between when the cleaning device 102 is mounted and when it is removed. Moreover, the center of gravity position of the belt conveyor device 200 changes when the positions of the primary transfer rollers 107 are changed by the primary transfer roller separating mechanism in each case of image formation.

As shown in FIG. 8, in a state where the cleaning device 102 is mounted, the center of gravity position of the belt conveyor device 200 is given as a first center of gravity position A(30*a*), a first center of gravity position B(30*b*), and a first center of gravity position C(30*c*), respectively, for the time of separation, the time of monochrome image formation, and the time of color image formation. Furthermore, in a state where the cleaning device 102 is removed, the center of gravity position of the belt conveyor device 200 is given as a second center of gravity position D(31*d*), a second center of gravity position E(31*e*), and a second center of gravity position F(31*f*), respectively, for the time of separation, the time of monochrome image formation, and the time of color image formation. In the present embodiment, unless otherwise specified, the center of gravity position of the belt conveyor device 200 refers to the center of gravity position of the belt conveyor device 200 when the cleaning device 102 is mounted.

Moreover, as shown in FIG. 8, a front-side grip portion 20*c* is provided at an end position in the width direction of the belt conveyor device 200, and a rear-side grip portion 20*b* is provided at the other end position. Here, a range from a tip end to a rear end of the front-side grip portion 20*c* in a belt conveyance direction V is given as a front-side grip portion holding range 32*c*, and a range from a tip end to a rear end of the rear-side grip portion 20*b* is given as a rear-side grip portion holding range 32*b*.

A positional relationship is such that the second center of gravity position D(31*d*), the second center of gravity position E(31*e*), and the second center of gravity position F(31*f*) in the belt conveyance direction V are included in both the front-side grip portion holding range 32*c* and the rear-side grip portion holding range 32*b*.

Accordingly, at the time of holding the belt conveyor device 200 to remove the cleaning device 102 from the belt conveyor device 200, because the center of gravity position is included in the front-side grip portion holding range 32*c* and the rear-side grip portion holding range 32*b*, the belt conveyor device 200 may be highly stably held.

On the other hand, when the cleaning device 102 is mounted, the center of gravity position is not included in the front-side grip portion holding range 32*c* and the rear-side grip portion holding range 32*b*. Accordingly, the belt conveyor device 200 cannot be stably held, and there is a risk of damaging the image forming apparatus main body or other parts due to the belt conveyor device bumping into the image forming apparatus main body or other parts.

<Structure of Grip Portion of Belt Conveyor Device (Example Embodiment)>

Here, a structure of the grip portion of the belt conveyor device of the present embodiment, which is characteristic to the present embodiment, will be described with reference to FIGS. 9A and 9B.

Figure 9B:
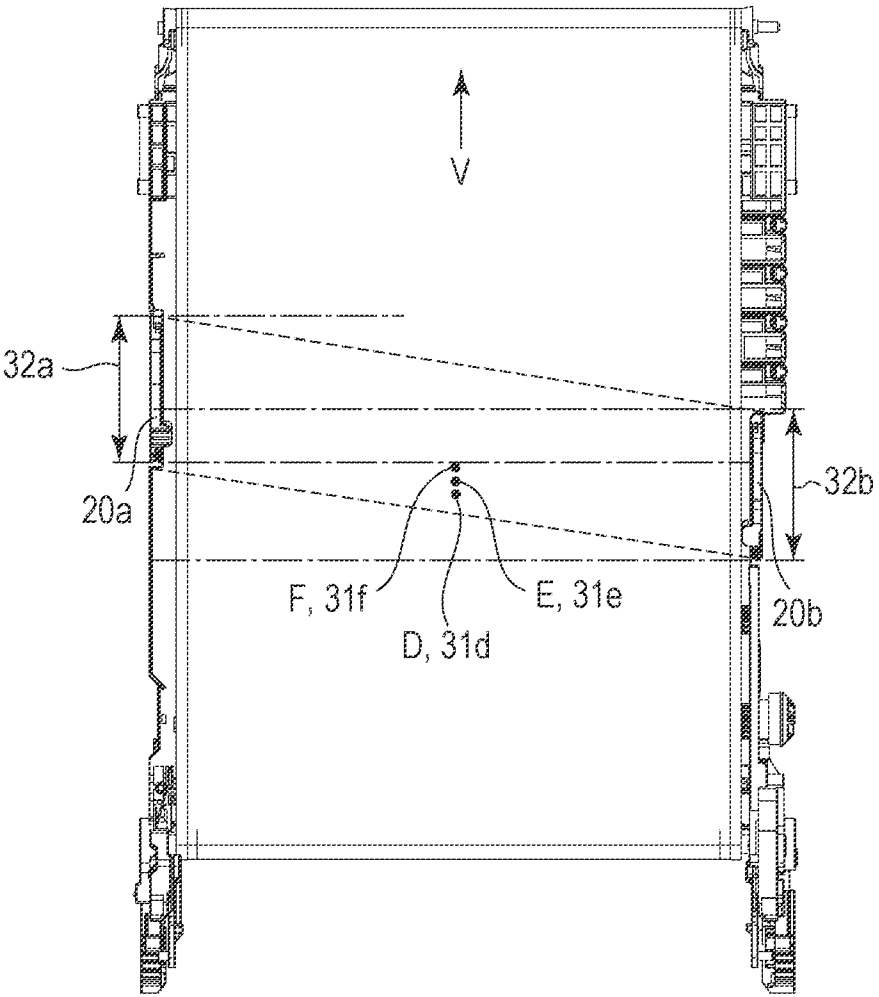
FIGS. 9A and 9B are top views of the belt conveyor device according to the present embodiment.
Figure 9A:
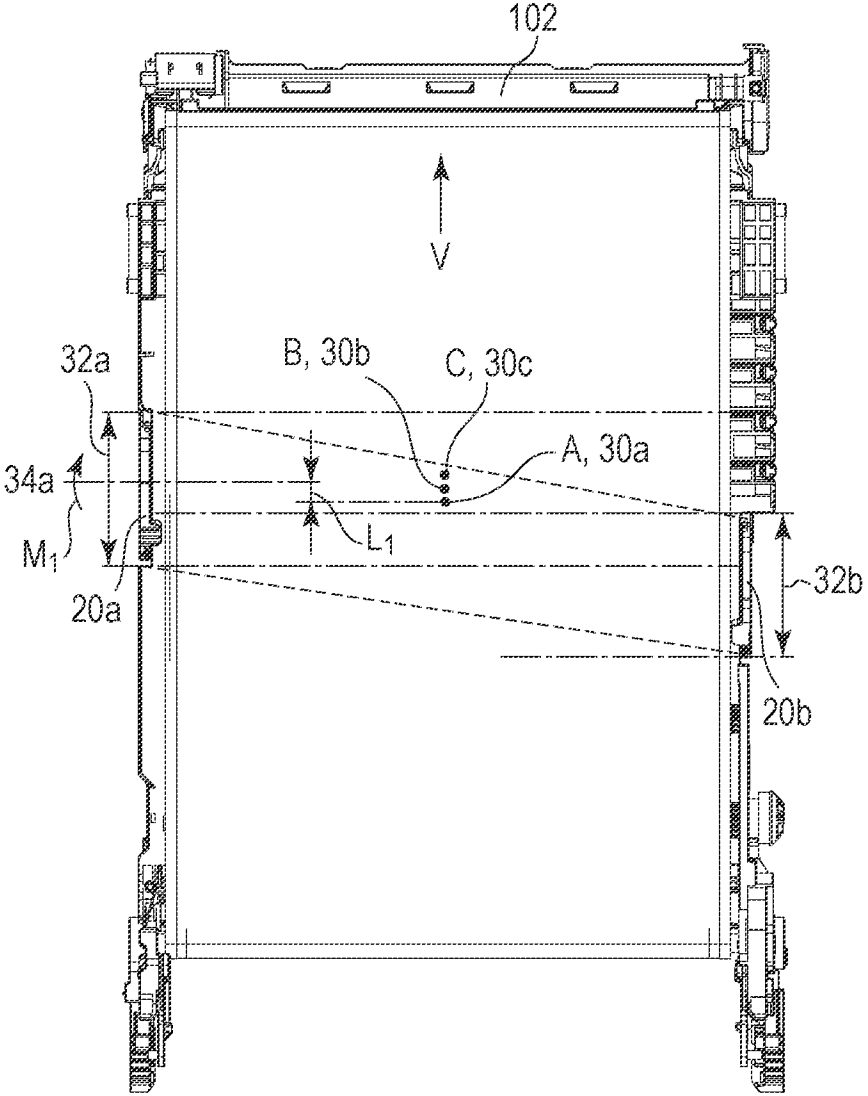

FIG. 9A is a top view of the belt conveyor device 200 when the cleaning device 102 is mounted. FIG. 9B is a top view of the belt conveyor device 200 when the cleaning device 102 is removed. Center of gravity positions A to F of the belt conveyor device 200 are shown in FIGS. 9A and 9B. In the present embodiment, because the primary transfer roller separating mechanism is provided, the positions of the primary transfer rollers 107 are changed by a separation operation in each case of image formation. Accordingly, in addition to mounting/detachment of the cleaning device 102, the center of gravity position of the belt conveyor device 200 is changed by the separation operation. In the present embodiment, the first center of gravity positions A to C are different from the second center of gravity positions D to F in the belt conveyance direction V (the insertion direction of the belt conveyor device).

As shown in FIG. 9A, in a state where the cleaning device 102 is mounted, the center of gravity position of the belt conveyor device 200 is given as a first center of gravity position A(30*a*), a first center of gravity position B(30*b*), and a first center of gravity position C(30*c*), respectively, for the time of separation, the time of monochrome image formation, and the time of color image formation. Furthermore, as shown in FIG. 9A, the front-side grip portion 20*a* is provided on one end side (front side of the image forming apparatus main body) in a belt width direction of the belt conveyor device 200. Moreover, the rear-side grip portion 20*b* is provided on the other end side (rear side of the image forming apparatus main body) in the belt width direction of the belt conveyor device 200. Here, a range from a tip end to a rear end of the front-side grip portion 20*a* in the belt conveyance direction V is given as a front-side grip portion holding range 32*a*, and a range from a tip end to a rear end of the rear-side grip portion 20*b* is given as a rear-side grip portion holding range 32*b*.

The first center of gravity position A(30*a*), the first center of gravity position B(30*b*), and the first center of gravity position C(30*c*) in the belt conveyance direction V are included in the front-side grip portion holding range 32*a*. On the other hand, the center of gravity positions A to C of the belt conveyor device 200 in the present embodiment are on the downstream side of a center of the belt conveyor device 200 in the insertion direction of the belt conveyor device. Furthermore, as described above, the electrical contact portions (HVa, HVb, HVc, HVd) are arranged to be on the downstream side in the insertion direction of the belt conveyor device as much as possible. Accordingly, in the present embodiment, the center of gravity positions of the belt conveyor device 200 are positioned in a range, in the belt conveyance direction V, where the electrical contact portions (HVa, HVb, HVc, HVd) are provided. Furthermore, the rear-side grip portion 20*b* is arranged on the upstream side of the electrical contact portions (HVa, HVb, HVc. HVd) in the insertion direction of the belt conveyor device 200. That is, a positional relationship is such that the first center of gravity position A(30*a*), the first center of gravity position B(30*b*), and the first center of gravity position C(30*c*) are not included in the rear-side grip portion holding range 32*b* in the belt conveyance direction V.

In other words, when the belt conveyor device 200 mounted in the apparatus main body is seen from above, the first center of gravity positions A to C are positioned in the front-side grip portion holding range 32*a* in the insertion direction of the belt conveyor device 200, but the second center of gravity positions D to F are not. Moreover, when the belt conveyor device 200 mounted in the apparatus main body is seen from above, the second center of gravity positions D to F are positioned in the rear-side grip portion holding range 32*b* in the insertion direction of the belt conveyor device 200, but the first center of gravity positions A to C are not. Accordingly, in the case of holding the belt conveyor device 200 by holding the front-side grip portion 20*a* and the rear-side grip portion 20*b* at the same time, holding can be performed with high stability for the following reason. That is, in a state in FIG. 9A where the cleaning device 102 is mounted on the belt conveyor device 200, the center of gravity positions of the belt conveyor device 200 are included in the front-side grip portion holding range 32*a*. Gripping can be therefore performed with high stability.

Next, a case is considered where the cleaning device 102 is removed from the belt conveyor device 200, as shown in FIG. 9B. In this case, center of gravity positions of the belt conveyor devices 200 at the time of separation, at the time of monochrome image formation, and at the time of color image formation are given as a second center of gravity position D(31*d*), a second center of gravity position E(31*e*), and a second center of gravity position F(31*f*), respectively. Furthermore, as shown in FIG. 9B, the second center of gravity position D(31*d*), the second center of gravity position E(31*e*), and the second center of gravity position F(31*f*) are not included in the front-side grip portion holding range 32*a* in the belt conveyance direction V. On the other hand, the second center of gravity position D(31*d*), the second center of gravity position E(31*e*), and the second center of gravity position F(31*f*) are included in the rear-side grip portion holding range 32*b*.

Accordingly, at the time of holding the belt conveyor device 200, the front-side grip portion 20*a* and the rear-side grip portion 20*b* are held at the same time. In the state in FIG. 9B where the cleaning device 102 is removed, the center of gravity positions D to F are included in the rear-side grip portion holding range 32*b*. Accordingly, holding can be performed with high stability. Moreover, as shown in FIGS. 9A and 9B, in each of cases where the cleaning device 102 is mounted and where it is removed, the grip portion on only one side covers the center of gravity position in each state. Furthermore, as shown in FIGS. 9A and 9B, in the present embodiment, an upstream end of the front-side grip portion 20*a* is on the downstream side of an upstream end of the rear-side grip portion 20*b* in the insertion direction of the belt conveyor device 200 (i.e., the arrow V direction in the drawings). Moreover, in the belt conveyance direction V, a length of each of the front-side grip portion 20*a* and the rear-side grip portion 20*b* is longer than a distance between the first center of gravity position C(30*c*) and the second center of gravity position D(31*d*) in the belt conveyance direction V. Accordingly, the grip portions do not have to be made unnecessarily large. This allows a risk of a user gripping a position which is offset from the center of gravity position to be reduced.

Furthermore, in the present embodiment, each of the center of gravity positions A to F is arranged inside a region surrounded by four points on both ends of the front-side grip portion 20*a* and both ends of the rear-side grip portion 20*b*. This allows the belt conveyor device 200 to be stably gripped even when the center of gravity position is changed before and after mounting of the cleaning device.

Heretofore, the structure of the grip portion of the belt conveyor device, which is characteristic to the present embodiment, has been described in comparison to the comparative example. An effect of the present embodiment will be described in greater detail.

<Moment for Rotating Belt Conveyor Devices of Comparative Example and Present Embodiment>

At the time of replacing the belt, depending on the center of gravity position, moment is generated when the belt conveyor device 200 is held. A weight of the belt conveyor device 200 is given as F, and moment for rotating the belt conveyor device 200 when the belt conveyor device 200 is held and raised is given as M.

As shown in FIG. 8, with the structure of the comparative example, moment $M_2$ that is generated when the front-side grip portion 20*c* and the rear-side grip portion 20*b* are held and raised is $F \times L_2$. Additionally, $L_2$ indicates a distance from a second rotation axis 34*b* to the first center of gravity position A(30*a*) in the belt conveyance direction V, where the second rotation axis 34*b* is a midline in the front-side grip portion holding range 32*c*.

Next, in the present embodiment, as shown in FIG. 9A, moment $M_1$ that is generated when the front-side grip portion 20*a* and the rear-side grip portion 20*b* are held and raised is $F \times L_1$. Additionally, $L_1$ indicates a distance from a first rotation axis 34*a* to the first center of gravity position A(30*a*) in the belt conveyance direction V, where the first rotation axis 34*a* is a midline in the front-side grip portion holding range 32*a*.

Because $L_2 > L_1$ is clearly true, when $M_2$ and $M_1$ are compared, $M_2 > M_1$ is established. That is, in the comparative example, the moment M cannot be reduced when the cleaning device 102 is mounted or when the primary transfer rollers 107 are separated. On the other hand, the moment M can be reduced in the present embodiment. Furthermore, in the comparative example, a grip is offset from the center of gravity position of the belt conveyor device 200, and thus, gripping cannot be performed stably. On the other hand, in the present embodiment, the center of gravity position can be positioned in the region sandwiched by the front-side grip portion 20*a* and the rear-side grip portion 20*b* on both sides, even in the case where the center of gravity position is shifted by attachment/detachment of the cleaning device 102. The same can be said for the time of monochrome image formation and for the time of color image formation.

Accordingly, with the present embodiment, the moment M may be reduced at all the positions of the primary transfer rollers 107, in a case where the cleaning device 102 is mounted on the belt conveyor device 200 and when the cleaning device 102 is removed therefrom.

<Example Measurement Method of Center of Gravity Position>

The center of gravity position of the belt conveyor device 200 may be easily checked in the following manner. That is, whether or not the center of gravity position of the belt conveyor device 200 is at a position overlapping the front-side grip portion 20*a* in the conveyance direction of the belt conveyor device 200 may be easily checked in the following manner. First, the belt conveyor device 200 is supported at two arbitrary points on a front side, and also, the belt conveyor device 200 is supported at two arbitrary points on a rear side. At this time, if rotational moment is generated on the belt conveyor device 200 and the belt conveyor device 200 cannot be horizontally supported, it can be understood that the center of gravity position of the belt conveyor device 200 is not inside the region surrounded by the four support points. Accordingly, determination may be performed on the basis of whether the belt conveyor device 200 may be supported at four points in total, namely, two points on both ends of the front-side grip portion 20*a* and two points on the rear side which are on an opposite side, in the belt width direction, from the two points on both ends of the front-side grip portion 20*a*.

With the structure as described above, at the time of replacement of the intermediate transfer belt 101, the grip portion on one side surely covers the center of gravity position when the cleaning device 102 is mounted or removed from the belt conveyor device 200. Accordingly, moment that is generated may be made small. Moreover, also in the case where the center of gravity position is changed depending on the positions of the primary transfer rollers 107, the grip portion on one side covers the center of gravity position. Accordingly, moment that is generated may be made small. The belt conveyor device may thus be held with high stability at all times, and a risk of the belt conveyor device 200 bumping into the image forming apparatus main body or other parts and causing damages may be eliminated. Moreover, the unit to be mounted is not limited to the cleaning device 102, and any unit that can be mounted on the belt conveyor device 200 may be made a target of application.

Additionally, in the present embodiment, the center of gravity position are caused to take three positions (A to C, or D to F) by the separation operation of the primary transfer rollers. Furthermore, the grip portions are arranged in such a way that one grip portion covers the center of gravity position before the cleaning device is mounted, and the other grip portion covers the center of gravity position after the cleaning device is mounted, regardless of the position among the three positions. However, arrangement is also allowed, according to which the relationship between the grip portions and the center of gravity position is satisfied with respect to at least one position among the three positions.

According to the present disclosure, there may be provided a belt conveyor device or an image forming apparatus with which a sliding distance between an electrical contact on an apparatus main body side and the belt conveyor device may be suppressed while allowing the belt conveyor device to be stably gripped, even if a center of gravity position of the belt conveyor device is positioned on a downstream side of the belt conveyor device in an insertion direction.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-134289, filed Jul. 17, 2018, which is hereby incorporated by reference herein in its entirety.

What is claimed is:

1. A transfer belt unit, having an endless belt to which a toner image is transferred, configured to be detachably attachable to a main body of an image forming apparatus in an insertion direction of the transfer belt unit intersecting a width direction of the belt, the transfer belt unit comprising:

a plurality of rollers where the belt is stretched;

a frame for rotatably supporting the plurality of rollers;

a first grip portion provided on a first side of the frame in the width direction;

a second grip portion provided on a second side of the frame in the width direction;

a plurality of transfer rollers configured to transfer the toner image to the belt;

an electrical contact portion, provided on the second side of the frame in the width direction, to be electrically connected to and abut contact members provide in the main body of the image forming apparatus, and configured to form electrical paths to supply bias to the transfer rollers; and wherein a device downstream end of the second grip portion is provided upstream of both a center of gravity position of the transfer belt unit and the electrical contact portion in the insertion direction of the transfer belt unit, and wherein a position at which the center of gravity position of the transfer belt unit is projected in a perpendicular direction perpendicular to both the insertion direction and the width direction is provided inside a region in which a region that is surrounded by both ends of the first grip portion and both ends of the second grip portion is projected in the perpendicular direction.

2. The transfer belt unit according to claim 1, wherein an upstream end of the first grip portion is provided upstream of the center of gravity position of the transfer belt unit and a downstream end of the first grip portion is provided downstream of the center of gravity position of the transfer belt unit and, an upstream end of the first grip portion is provided downstream of an upstream end of the second grip portion, in the insertion direction of the transfer belt unit.

3. The transfer belt unit according to claim 1, further comprising:

a cleaning unit, provided at a downstream side of the main body of the transfer belt unit in the insertion direction, configured to clean the belt, wherein the center of gravity position of the transfer belt unit in a state where the cleaning unit is mounted on the transfer belt unit is a first position, and a center of gravity position of a main body of the transfer belt unit in a state where the cleaning unit is dismounted from the main body of the transfer belt unit main is a second position, and wherein the downstream end of the second grip portion is provided downstream of the second position and an upstream end of the second grip portion is provided upstream of the second position, in the insertion direction of the transfer belt unit.

4. The transfer belt unit according to claim 3, wherein a length of each of the first grip portion and the second grip portion in the insertion direction of the transfer belt unit belt is longer than a distance between the first position and the second position.

5. The transfer belt unit according to claim 3, wherein an upstream end of the first grip portion is provided upstream of the first position and a downstream end of the first grip portion is provided downstream of the first position, in the insertion direction of the transfer belt unit.

6. The transfer belt unit according to claim 3, wherein an upstream end of the first grip portion is provided downstream of a second position in the insertion direction of the transfer belt unit.

7. The transfer belt unit according to claim 1, wherein the center of gravity position of the transfer belt unit is provided downstream of a center of the transfer belt unit in the insertion direction of the transfer belt unit, and wherein an upstream end of the electrical contact portion is provided upstream of the center of gravity position of the transfer belt unit and an downstream end of the electrical contact portion is provided downstream of the center of gravity position of the transfer belt unit, in the insertion direction of the transfer belt unit.

8. A transfer belt unit, having an endless belt to which a toner image is transferred, configured to be detachably attachable to a main body of an image forming apparatus in an insertion direction of the transfer belt unit intersecting a width direction of the belt, the transfer belt unit including, a plurality of rollers where the belt is stretched, a frame for rotatably supporting the plurality of rollers, a first grip portion provided on a first side of the frame in the width direction, a second grip portion provided on a second side of the frame in the width direction, a plurality of transfer rollers configured to transfer the toner image from the image bearing member to the belt, an electrical contact portion, provided on the second side of the frame in the width direction, to be electrically connected to and abut contact members provide in the main body of the image forming apparatus, and configured to form electrical paths to supply bias to the transfer roller, and a cleaning unit, provided at a downstream side of the main body of the transfer belt unit in the insertion direction, configured to clean the belt, wherein a center of gravity position of the transfer belt unit in a state where the cleaning unit is mounted on a main body of the transfer belt unit is a first position, and the center of gravity position of the transfer belt unit in a state where the cleaning unit is dismounted from the main body of the transfer belt unit is a second position, wherein an upstream end of the first grip portion is provided upstream of the first position in the insertion direction, and a downstream end of the first grip portion is provided downstream of the first position in the insertion direction, and wherein a downstream end of the second grip portion is provided upstream of both the electrical contact portion and the first position and downstream of the second position in the insertion direction of the transfer belt unit, and an upstream end of the second grip portion is provided upstream of the second position in the insertion direction of the transfer belt unit.

* * * * *